US011732847B2

(12) United States Patent
Hopkins et al.

(10) Patent No.: US 11,732,847 B2
(45) Date of Patent: Aug. 22, 2023

(54) PORTABLE LIGHT, SUCH AS A STICK LIGHT

(71) Applicant: MILWAUKEE ELECTRIC TOOL CORPORATION, Brookfield, WI (US)

(72) Inventors: Michael J. Hopkins, Antioch, IL (US); Kevin R. Kirk, Minnetonka, MN (US); Jonathan Kuta, Milwaukee, WI (US); Christina Prestidge-Kadrlik, Hartland, WI (US); Jeffrey L. Spenner, Germantown, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/574,218

(22) Filed: Jan. 12, 2022

(65) Prior Publication Data

US 2022/0221115 A1 Jul. 14, 2022

Related U.S. Application Data

(60) Provisional application No. 63/136,448, filed on Jan. 12, 2021.

(51) Int. Cl.
*F21L 4/04* (2006.01)
*F21L 4/02* (2006.01)
(Continued)

(52) U.S. Cl.
CPC ..... *F21L 4/045* (2013.01); *F21L 4/027* (2013.01); *F21L 4/085* (2013.01);
(Continued)

(58) Field of Classification Search
CPC . F21L 4/027; F21L 4/045; F21L 4/085; F21V 21/26; F21V 21/30
See application file for complete search history.

(56) References Cited

U.S. PATENT DOCUMENTS 4,244,011 A 1/1981 Hammel et al.
5,165,048 A * 11/1992 Keller ..... F21L 4/085 362/183

(Continued)

FOREIGN PATENT DOCUMENTS

CN 101576203 A 11/2009
CN 202510997 U 10/2012

(Continued)

OTHER PUBLICATIONS

International Search Report and Written Opinion for Application No. PCT/US2022/012138 dated Apr. 25, 2022 (10 pages).

*Primary Examiner* — Alexander K Garlen
(74) *Attorney, Agent, or Firm* — Michael Best & Friedrich LLP

(57) ABSTRACT

A portable light including an elongated housing having a first end and a second end opposite the first end, and a light-emitting head pivotably coupled to the second end of the elongated housing. The light-emitting head having a housing portion defining a first end and a second end opposite the first end. A first light source is coupled to a first side of the light-emitting head and is positioned between the first end and the second end of the housing portion. A second light source coupled to the second end of the housing portion. A battery cell is removably coupled to the elongated housing to power the first and second light sources.

20 Claims, 11 Drawing Sheets

(51) Int. Cl.
*F21V 23/04* (2006.01)
*F21L 4/08* (2006.01)
*F21Y 115/10* (2016.01)

(52) U.S. Cl.
CPC ..... *F21V 23/0414* (2013.01); *F21V 23/0428* (2013.01); *F21Y 2115/10* (2016.08)

(56) References Cited

U.S. PATENT DOCUMENTS 5,541,822 A 7/1996 Bamber
5,558,430 A 9/1996 Booty, Jr.
5,605,394 A 2/1997 Chen
5,746,495 A 5/1998 Klamm
5,871,272 A 2/1999 Sharrah et al.
D409,776 S 5/1999 Ghode et al.
5,971,562 A 10/1999 Yang
5,988,828 A 11/1999 Prince et al.
6,012,824 A 1/2000 Sharrah et al.
6,250,771 B1 6/2001 Sharrah et al.
6,316,911 B1 11/2001 Moskowitz et al.
6,350,040 B1 2/2002 Parker
6,457,841 B1 10/2002 Lynch et al.
6,523,972 B2 2/2003 Sharrah et al.
6,633,152 B2 10/2003 Sharrah et al.
6,641,279 B1 11/2003 Williams
6,652,115 B2 11/2003 Sharrah
6,659,621 B2 12/2003 Sharrah et al.
6,752,514 B2 6/2004 Parker
6,817,730 B2 11/2004 Sharrah et al.
6,899,441 B2 5/2005 Chen
6,909,260 B2 6/2005 Parker
6,994,451 B2 2/2006 Galli
7,008,084 B2 3/2006 Galli
7,011,423 B2 3/2006 Chen
7,059,744 B2 6/2006 Sharrah
7,109,683 B2 9/2006 Parker
D536,464 S 2/2007 Kingston et al.
7,246,927 B2 7/2007 Wikle et al.
7,314,286 B2 1/2008 Sharrah et al.
7,401,941 B2 7/2008 Teng et al.
7,481,551 B2 1/2009 Sharrah
7,553,051 B2 6/2009 Brass et al.
7,557,536 B2 7/2009 Lobert et al.
7,591,572 B1 * 9/2009 Levine ..... A47F 11/10 362/427
7,690,813 B2 4/2010 Kanamori et al.
7,699,491 B2 4/2010 Sharrah et al.
7,731,385 B2 6/2010 Spartano et al.
7,819,546 B1 10/2010 Kazmerowski et al.
7,850,330 B2 12/2010 Spartano et al.
7,959,317 B2 6/2011 Spartano et al.
7,976,199 B2 7/2011 Berns et al.
8,033,680 B2 10/2011 Sharrah et al.
8,033,681 B2 10/2011 Brass et al.
RE42,945 E 11/2011 Sharrah et al.
8,066,402 B2 11/2011 Klipstein
8,087,797 B2 1/2012 Pelletier et al.
8,317,357 B2 11/2012 Bayat et al.
8,376,574 B2 2/2013 Spartano et al.
8,376,602 B2 2/2013 Klipstein
8,403,526 B2 3/2013 Bayat et al.
D681,246 S 4/2013 Keeley et al.
8,562,184 B2 10/2013 Klipstein et al.
D708,376 S 7/2014 Crowe et al.
8,770,801 B1 7/2014 Berns et al.
8,777,446 B2 7/2014 Sharrah et al.
8,789,963 B2 7/2014 Whitfield et al.
8,905,572 B2 12/2014 Mueckl et al.
9,046,230 B2 6/2015 O'Brien
9,068,707 B1 6/2015 Boxler et al.
9,182,089 B2 11/2015 Whitfield et al.
D752,263 S 3/2016 Keeley et al.
9,297,509 B2 3/2016 Klipstein et al.
9,360,177 B2 6/2016 Mueckl et al.
9,464,767 B2 10/2016 Whitfield et al.
9,541,244 B1 1/2017 Berezinski et al.
9,587,671 B2 3/2017 Bao
9,651,208 B2 5/2017 Sharrah et al.
9,739,467 B1 8/2017 Lehman et al.
9,774,273 B2 9/2017 Suzuki et al.
9,960,621 B2 5/2018 Ziegenfuss et al.
9,960,622 B2 5/2018 Ziegenfuss et al.
10,001,252 B2 6/2018 Inskeep
10,060,582 B2 8/2018 O'Brien
D837,428 S 1/2019 Arena
10,326,292 B2 6/2019 Zeisler et al.
10,378,744 B2 8/2019 Arena et al.
10,393,326 B2 8/2019 Inskeep
10,458,641 B2 10/2019 Proeber
10,627,056 B2 4/2020 Sharrah
2004/0130894 A1 7/2004 Galli
2009/0052181 A1 2/2009 Mao
2009/0135611 A1 5/2009 Lin
2009/0190332 A1 7/2009 Sharrah
2009/0261737 A1 * 10/2009 Wright ..... F21V 23/0492 315/297
2010/0040023 A1 2/2010 Gallagher et al.
2010/0041387 A1 2/2010 Khetawat et al.
2010/0041402 A1 2/2010 Gallagher et al.
2010/0041403 A1 2/2010 Khetawat et al.
2010/0041405 A1 2/2010 Gallagher et al.
2010/0225246 A1 9/2010 Spartano et al.
2010/0254122 A1 10/2010 Bayat et al.
2011/0149562 A1 6/2011 Spartano et al.
2012/0188753 A1 7/2012 Popper et al.
2014/0085875 A1 * 3/2014 Yang ..... H02J 7/0047 362/183
2014/0126192 A1 5/2014 Ancona et al.
2015/0247628 A1 9/2015 Li
2015/0267882 A1 * 9/2015 O'Brien ..... F21V 23/0442 362/183
2015/0267902 A1 9/2015 Zhang
2016/0268827 A1 * 9/2016 Ziegenfuss ..... H01M 10/46
2016/0356439 A1 * 12/2016 Inskeep ..... F21V 21/30
2018/0224077 A1 8/2018 Bian
2018/0283623 A1 10/2018 Bian
2018/0283624 A1 10/2018 Bian
2018/0340661 A1 * 11/2018 Inskeep ..... F21L 4/085
2018/0350206 A1 12/2018 Ihm
2019/0017662 A1 * 1/2019 Zheng ..... F21L 4/027
2019/0331306 A1 * 10/2019 Westling ..... F21V 5/006
2020/0224836 A1 * 7/2020 Mclennan ..... F21V 9/083
2020/0300446 A1 * 9/2020 Sergyeyenko ..... F21V 21/28

FOREIGN PATENT DOCUMENTS

CN 202546291 U 11/2012
CN 103162099 A 6/2013
CN 103162127 A 6/2013
CN 203052226 U 7/2013
CN 203131460 U 8/2013
CN 104266088 A 1/2015
CN 104976522 A 10/2015
CN 205372350 U 7/2016
CN 206072836 U 4/2017
CN 209054369 U 7/2019
CN 209279034 U 8/2019
EP 2541288 A1 1/2013
JP 2004241342 A 8/2004
KR 200473312 Y1 6/2014
WO 2020061595 A1 3/2020

* cited by examiner

PORTABLE LIGHT, SUCH AS A STICK LIGHT

CROSS-REFERENCE TO RELATED APPLICATIONS

This application claims priority to U.S. Provisional Patent Application No. 63/136,448 filed on Jan. 12, 2021, the entire contents of which are incorporated herein by reference.

BACKGROUND

The present technology relates to portable lights. More specifically, the technology relates to an LED-based stick light or trouble light that is powered by a DC power source.

Stick lights or trouble lights are commonly used to illuminate work areas that are otherwise difficult to light. Examples of these areas include engine compartments, ceiling spaces, basement areas, and the like. The lights are typically positioned such that they shine light in the desired area without being held by a user.

SUMMARY

In another aspect, a portable light is disclosed. The portable light includes an elongated housing having a first end and a second end opposite the first end, and a light-emitting head pivotably coupled to the second end of the elongated housing. The light-emitting head having a housing portion defining a first end and a second end opposite the first end. A first light source is coupled to a first side of the light-emitting head and is positioned between the first end and the second end of the housing portion. A second light source coupled to the second end of the housing portion. A battery cell is removably coupled to the elongated housing to power the first and second light sources.

In another aspect, a portable light is disclosed. The portable light includes an elongated housing having a first housing portion defining a grip portion and a second housing portion coupled to the first housing portion, an interface that rotatably couples the first housing portion to the second housing portion, a light source coupled to the second housing portion of the elongated housing, and a battery cell supported within the first housing portion and configured to power the light source. The battery cell is configured to rotate relative to the first housing portion with the second housing portion.

In another aspect, a portable light assembly is disclosed. The portable light assembly includes a portable light having an elongated housing having a first end and a second end opposite the first end. The portable light assembly also includes a light-emitting head pivotably coupled to the second end of the elongated housing. The portable light further includes a first battery cell supported within the elongated housing and configured to power the light-emitting head. The portable light also includes a charging interface positioned on a side of the elongated housing between the first end and the second end. The assembly also includes a charger having a housing defining a first cavity sized to receive at least a portion of the portable light and a second cavity positioned adjacent the first cavity and sized to receive at least a portion of a second battery cell. The charger also includes a first charging interface positioned within the first cavity, the first charging interface configured to interact with the portable charging interface when the portable light is received in the first cavity to charge the first battery cell. The charger also includes a second charging interface positioned within the second cavity, the second charging interface configured to interact with a second battery cell when the second battery cell is received in the second cavity to charge the second battery cell.

Other aspects will become apparent by consideration of the detailed description and accompanying drawings.

DETAILED DESCRIPTION

Figure 1:
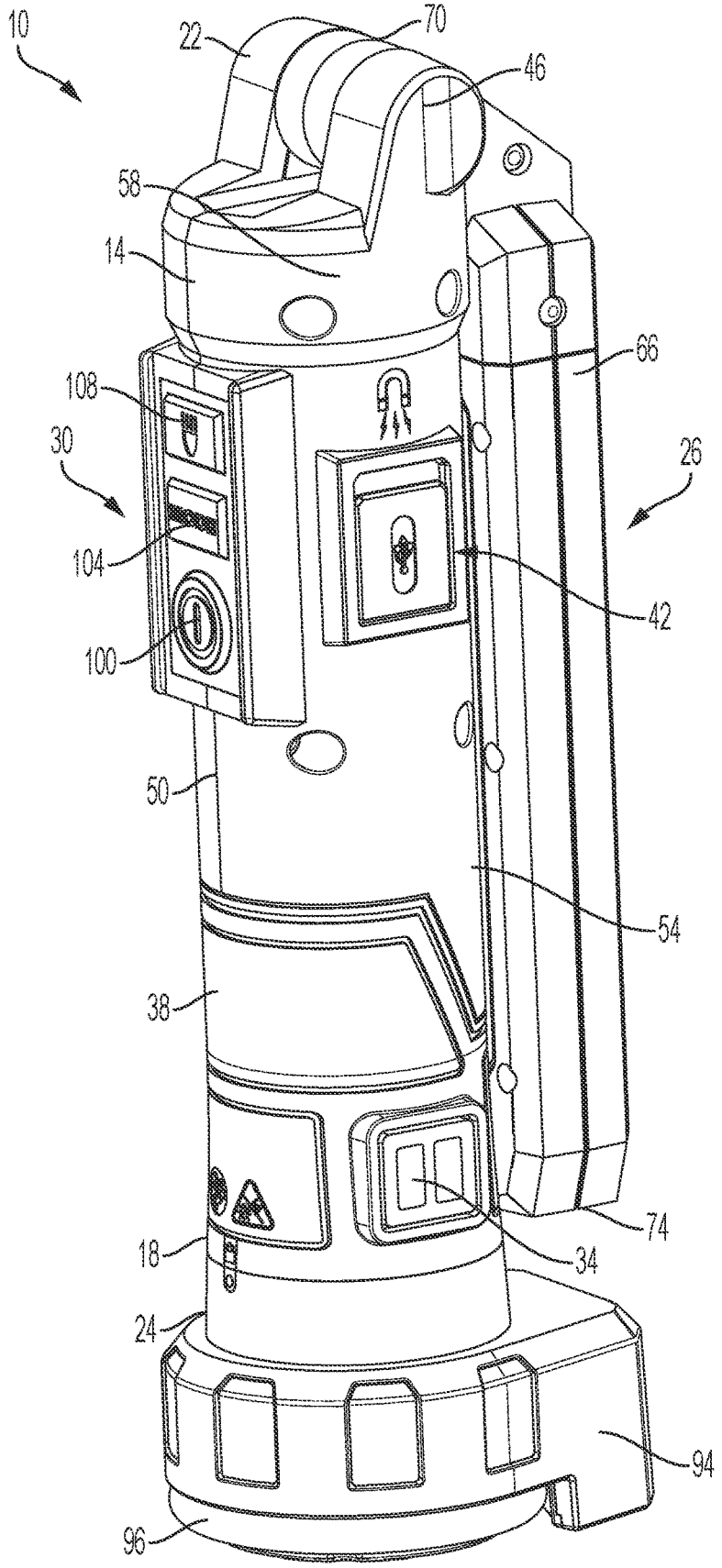
FIG. 1 is a perspective view of a portable light, according to some embodiments.

Before any embodiments of the herein described technology are explained in detail, it is to be understood that the disclosed technology is not limited in its application to the details of construction and the arrangement of components set forth in the following description or illustrated in the following drawings. The technology is capable of other embodiments and of being practiced or of being carried out in various ways.

FIGS. 1-8 illustrate a portable light 10, such as a stick light or trouble light. The illustrated stick light 10 is a hand-held, electrically powered light that includes an elongated housing 14 having a first end 18 and a second end 22 opposite the first end 18, a battery housing 24 coupled to the first end 18 of the housing 14 and sized to receive a battery cell 25 (FIG. 5), and a light-emitting head 26 pivotably and rotatably coupled to the second end 22 of the housing 14. A longitudinal axis 28 (FIGS. 2 and 3) extends centrally through the first and second ends 18, 22 of housing 14. The portable light 10 further includes a user interface 30 formed on the housing 14 to selectively activate the light-emitting head 26, a charging interface 34 formed on a grip portion 38 of the housing 14, and a universal serial bus ("USB") port 42 formed on the housing 14 adjacent the user interface 30. The charging interface 34 is sized to mate with a corresponding charging interface of an external charger (described in more detail below) to charge the battery cell 25. Alternatively, a USB cord may be coupled to the USB port 42 to charge the battery cell 25.

Figure 6:
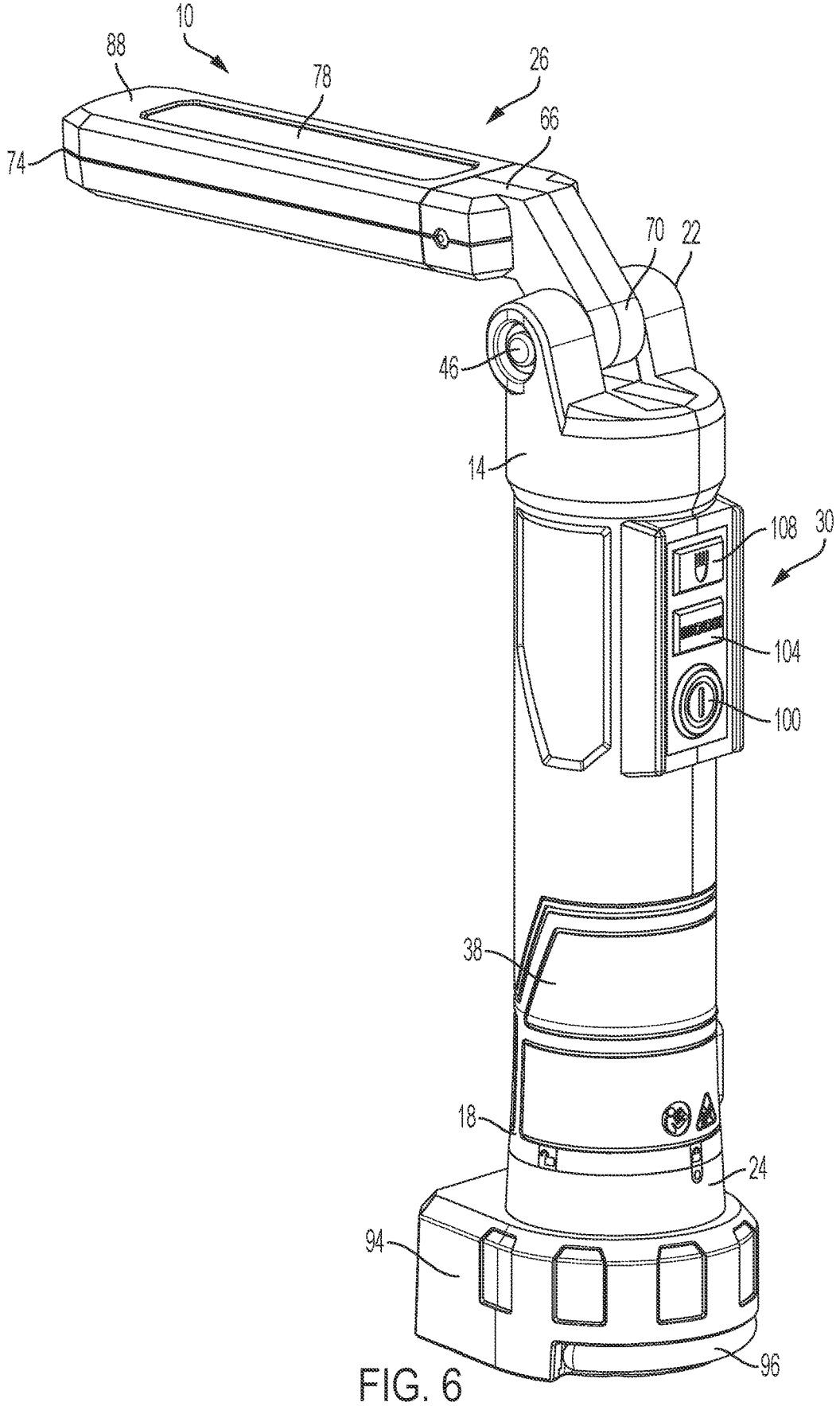
FIG. 6 is a perspective view of the portable light of FIG. 1, illustrating a light emitting head in an open position.
Figure 7:
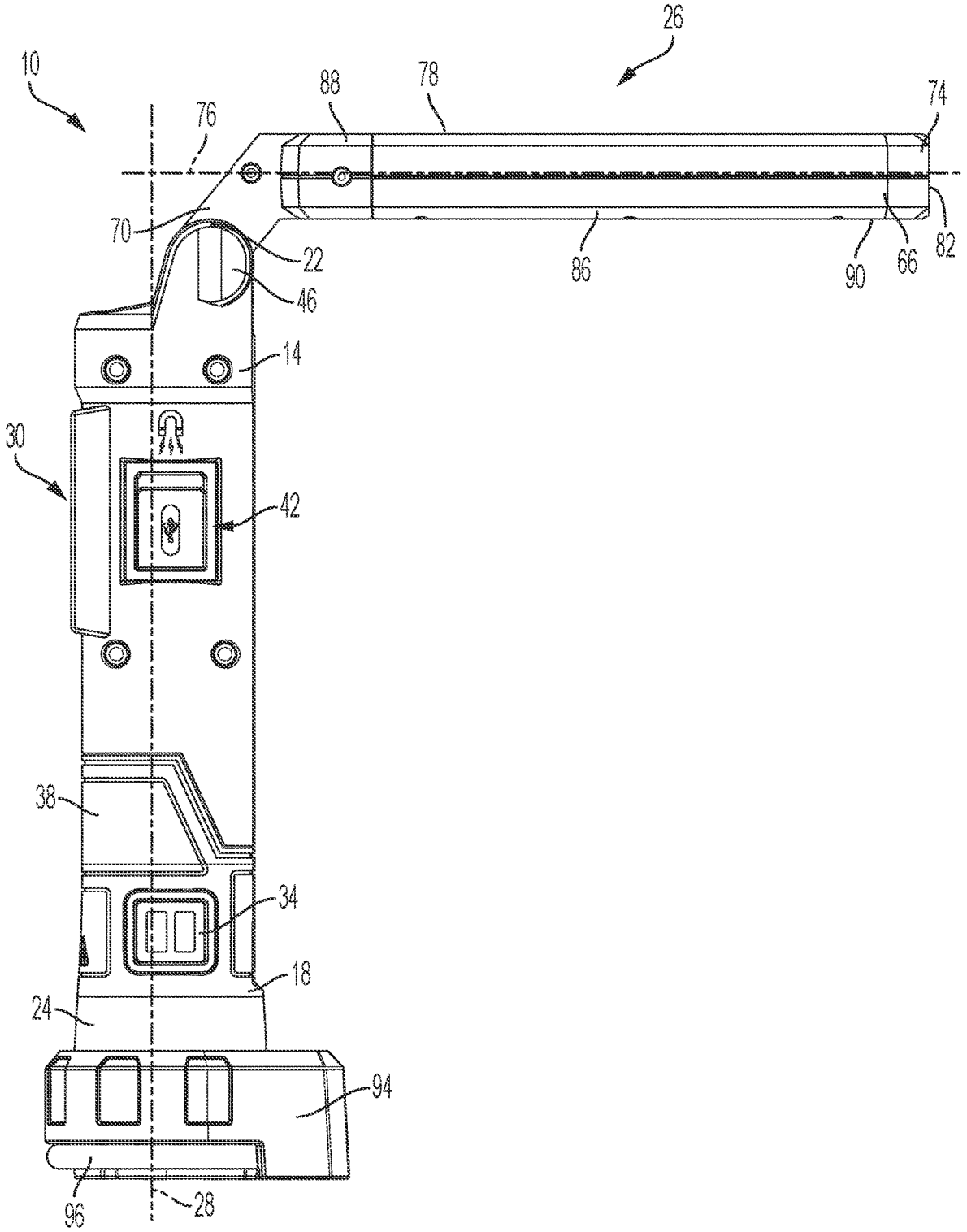
FIG. 7 is side view of the portable light of FIG. 1, illustrating the light emitting head in the open position.

The grip portion 38 is configured to be grasped by a user to hold and carry the portable light 10. In some embodiments, such as the illustrated embodiment, a relatively soft material may be positioned or molded over at least a portion of the grip portion 38 to increase the friction between a user's hand and the grip portion 38, which improves the user's grip of the housing 14. In operation, the battery cell 25 selectively provides power to the light-emitting head 26 to illuminate an area with the light-emitting head 26. The light-emitting head 26 is pivotably coupled to the housing 14 at a pivot point 46 and is movable between a first position (FIGS. 1-5) and a second position (FIGS. 6 and 7). The first position may be referred to as a closed or collapsed position. The second position may be referred to as an open or extended position. The light-emitting head 26 is rotatably coupled to the housing 14 such that the light-emitting head 26 can rotate about the longitudinal axis 28 (FIGS. 2 and 3) of the portable light 10. As a result, the user can maneuver the light-emitting head 26 to a desired position during operation.

Figure 2:
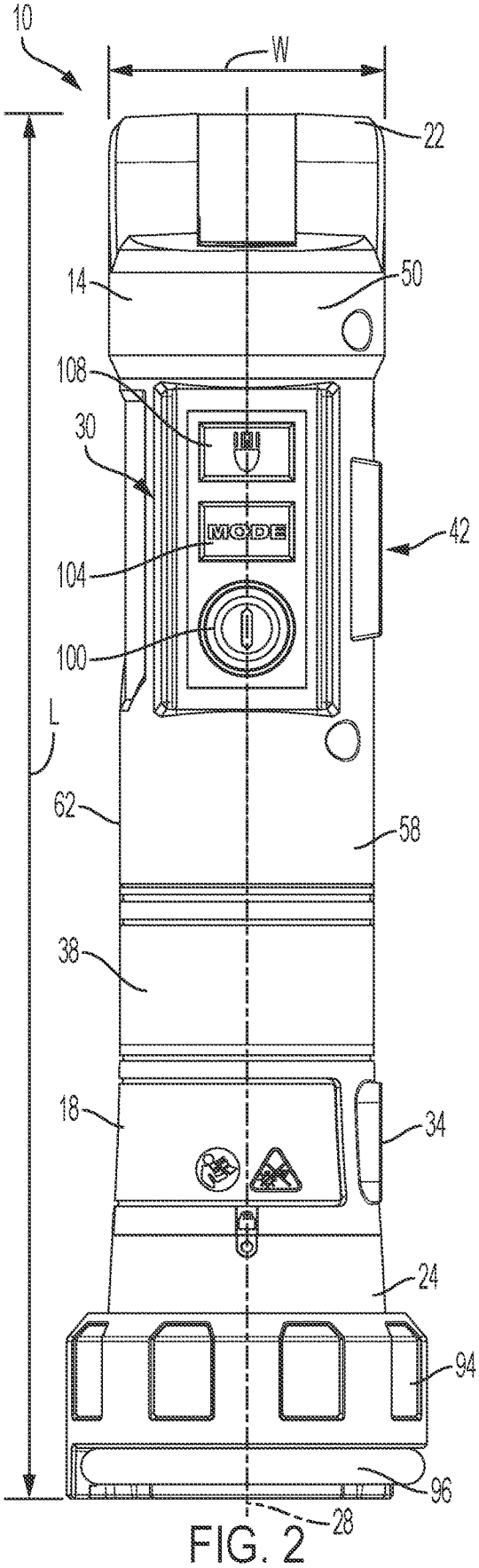
FIG. 2 is a front view of the portable light of FIG. 1.
Figure 3:
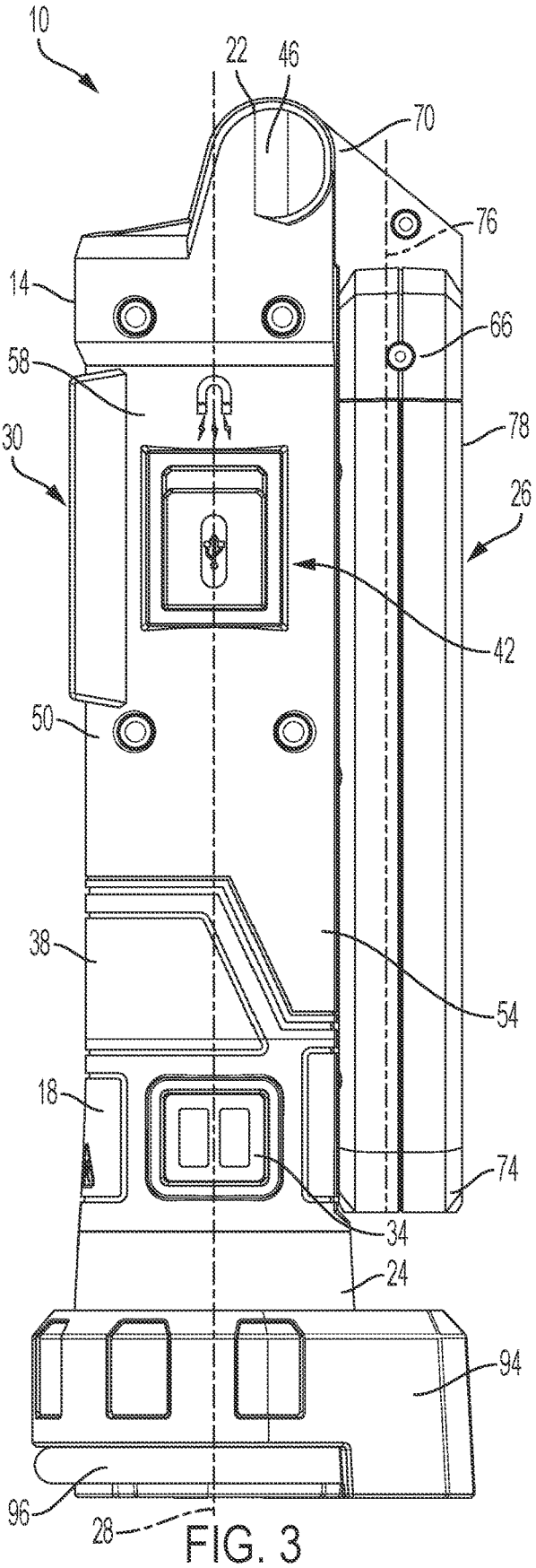
FIG. 3 is a side view of the portable light of FIG. 1.

With reference to FIGS. 2 and 3, the illustrated housing 14 is elongated in that an overall length L, or height, of the housing 14 is significantly greater than a width W (FIG. 2), or diameter, of the housing 14, giving the light 10 a stick or tube-shaped appearance. The elongated housing 14 defines a front side 50 (FIG. 3), a rear side 54, and right and left sides 58, 62 that extend between the front and rear sides 50, 54. When the light-emitting head 26 is in the closed position (FIG. 3), the light-emitting head 26 engages the rear side of the housing 14. In the illustrated embodiment, the user interface 30 is positioned on the front side 50 of the housing 14 and the USB port 42 and the charging interface 34 are positioned on one of the right or left sides 58, 62. For example, the USB port 42 and the charging interface 34 are both positioned on the right side 58 of the housing 14. In other embodiments, the USB port 42 and the charging interface 34 may be positioned on opposite sides of the housing 14 from each other.

Figure 4:
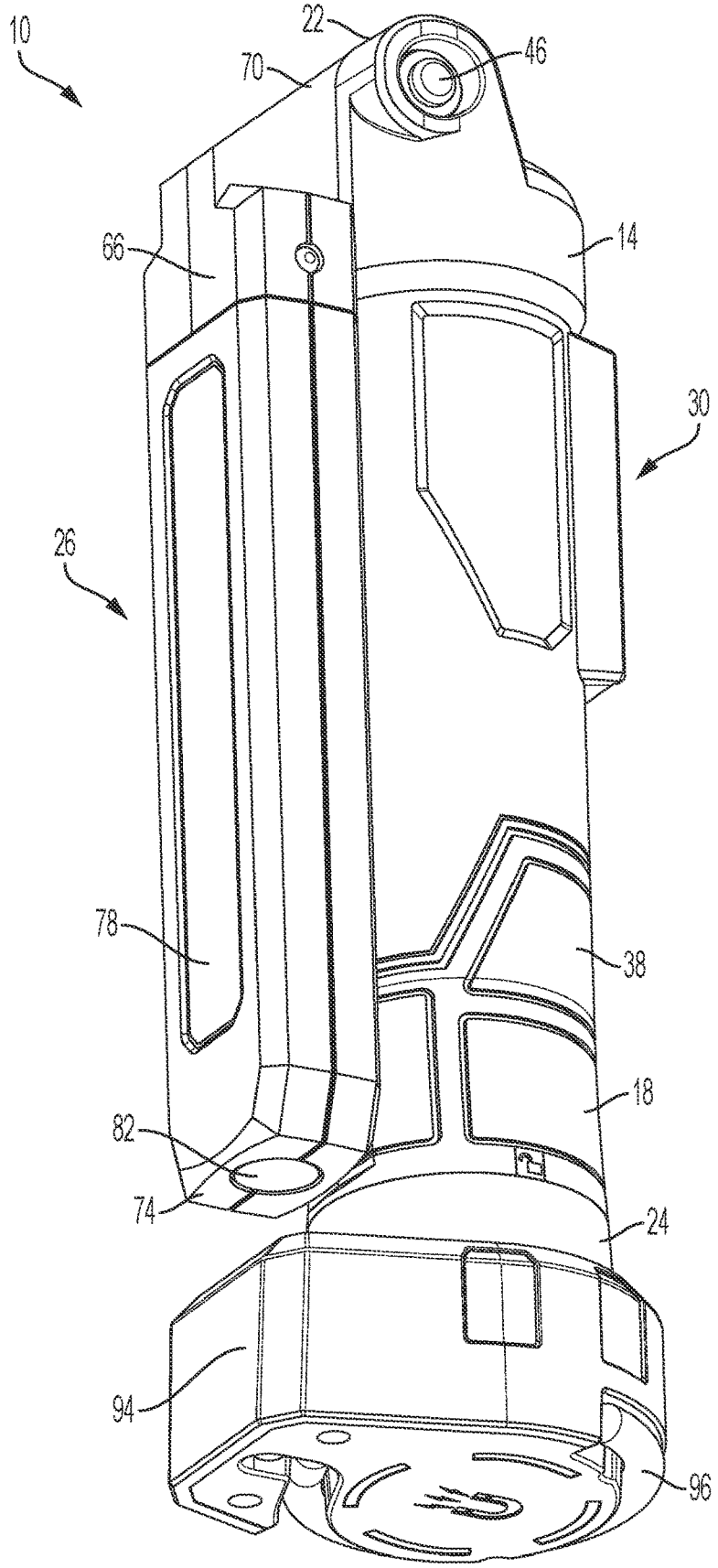
FIG. 4 is another perspective view of the portable light of FIG. 1.

The light-emitting head 26 includes a housing portion 66 having a first end 70 coupled to the second end 22 of housing 14, a second end 74 opposite the first end 70 (e.g., that terminates proximate the first end 18 of the housing 14), and a longitudinal axis 76 extending through the first and second ends 70, 74. The housing portion 66 houses a plurality of light sources 78, 82, 86 (FIGS. 4 and 7). In the illustrated embodiment, a first light source 78 (FIGS. 4, 5, and 7) is housed on a top surface 88 (FIG. 7) of the housing portion 66, a second light source 82 (e.g., a spotlight) is housed on the second end 74 of the housing portion 66, and a third light source 86 is housed on a bottom surface 90 of the housing portion 66. As such, the light sources 78, 82, 86 are oriented to emit light outward from each side of the housing portion 66. In the illustrated embodiment, the light sources 78, 82, 86 are LED light sources. Each light source 78, 82, 86 may include a single LED light source or a plurality or array of LED light sources.

Figure 5:
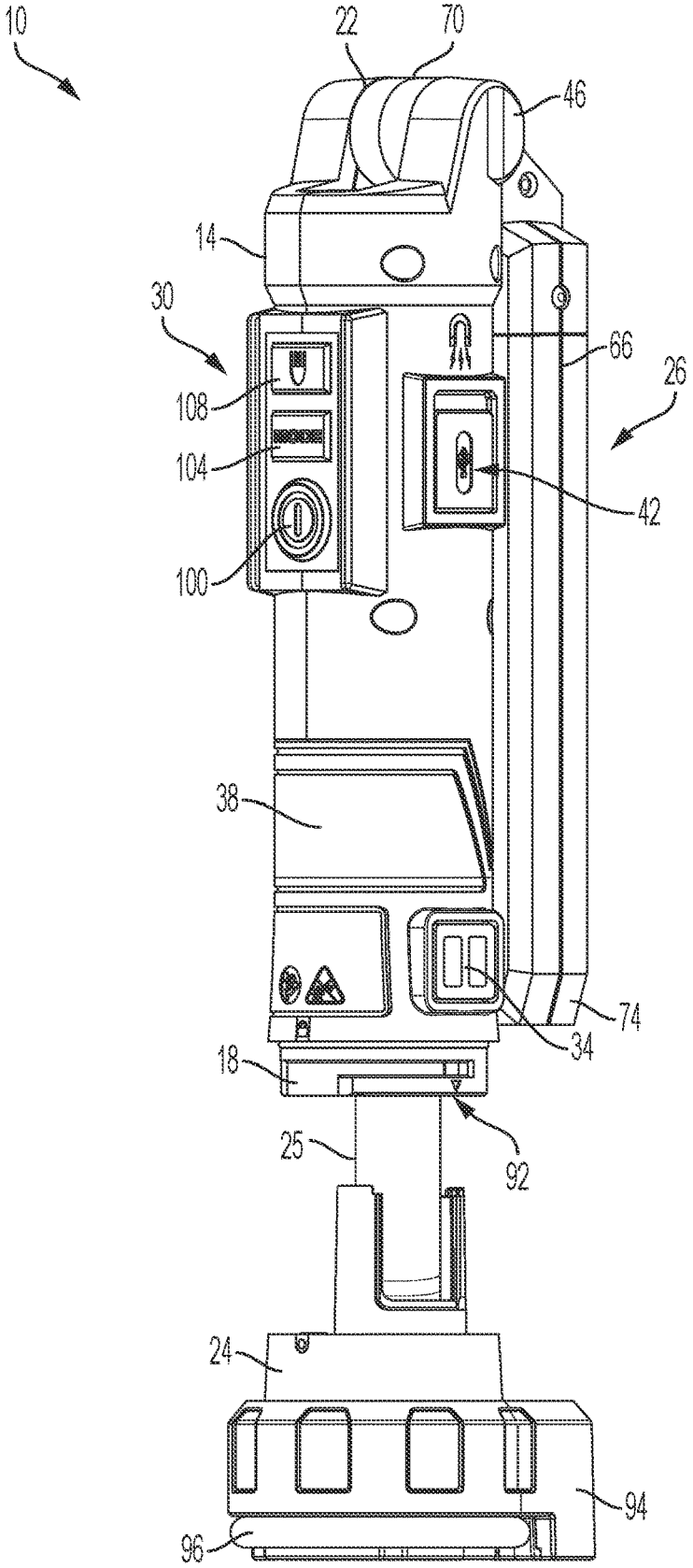
FIG. 5 is a perspective exploded view of the portable light of FIG. 1, illustrating a battery cell removed from the portable light.

Now with reference to FIG. 5, a battery receptacle 92 is adjacent the first end 18 of the elongated housing 14. In the illustrated embodiment, the battery receptacle 92 includes a recess formed in the first end 18 of the housing 14. The recess is adapted to receive the battery cell 25 and a portion of the battery housing 24. In other embodiments, the battery receptacle 92 may include guide rails to support a slide-on-style battery pack. In one embodiment, the illustrated battery cell 25 is a 3.6 volt battery cell. In one example, the battery cell 25 may be a lithium-ion battery cell, such as an 18650 cell. However, other battery chemistries, such as lithium iron phosphate, Nickle metal hydride, lead acid, alkaline, etc. are also contemplated. Further, other battery cell designs are contemplated other than the 18650.

As shown in FIGS. 1-7, an outer surface of the housing 14 and an outer surface of the battery housing 24 are similarly shaped and contoured such that the battery housing 24 forms an extension of the grip portion 38 when connected to the elongated housing 14. In the illustrated embodiment, the battery housing 24 further includes a base 94 that stabilizes the portable light 10 when the portable light 10 is positioned on a surface. The battery housing 24 also includes an attachment member 96 pivotably coupled to the base 94. The attachment member 96 may be used to hang or suspend the portable light 10 from various support structures, including cables, pipes, joists, nails, wall hangers, carabiners, belts, belt loops, shirt pockets, and the like. In the illustrated embodiment, the attachment member 96 is hook. The attachment member 96 is movable (e.g., pivotable) relative to the base 94 between a storage position (as shown) and an operation position. When in the storage position, the attachment member 96 is received within a recess of the base 94 such that the attachment member 96 does not extend beyond a periphery or footprint of the base 94. When in the operation position, the attachment member 96 extends outwardly away from the base 94 such that the attachment member can engage a support structure.

Referring back to FIGS. 1 and 2, the user interface 30 includes a power button 100, a mode selector 104, and an intensity selector 108 positioned on the front side 50 of the elongated housing 14. The user interface 30 is electrically coupled to the battery cell 25 and the light sources 78, 82, 86 through a controller and/or circuit within the housing 14 to control operation of the portable light 10. The illustrated user interface 30 is located generally in the middle of the elongated housing 14 and on an opposite side of the housing 14 from the light-emitting head 26. In addition, the user interface 30 is positioned adjacent the grip portion 38 such that a user holding the portable light 10 at the grip portion 38 can easily operate the light 10 with a single hand.

In the illustrated embodiment, the power button 100 is a button that may be depressed or otherwise actuated by a user to turn the portable light 10 (particularly the light sources 78, 82, 86) on and off. The mode selector 104 is a button that may be depressed or otherwise actuated by the user to switch between different operational modes. For example, the mode selector 104 may switch between modes where only one of the light sources 78, 82, 86 is on, two of the light sources 78, 82, 86 are on, or all three light sources 78, 82, 86 are on. The intensity selector 108 is a user actuatable input that adjusts the intensity of the light being emitted by the light sources 78, 82, 86 (e.g., brightens or dims the light sources 78, 82, 86). For example, the intensity selector 108 may be depressed or otherwise actuated multiple times to change the intensity of the light being emitted from a low intensity setting to a high intensity setting, or vice versa. Additionally, the mode selector 104 and intensity selector 108 may each include an indicator, such as a meter, positioned on the housing 14 to indicate to the user the current mode of the portable light 10 or the intensity level of the light being emitted.

During operation of the portable light 10, a user may use the portable light 10 with the light-emitting head 26 in the closed position (FIGS. 1-5) or the open position (FIGS. 6 and 7). Where the light-emitting head 26 is in the closed position, the longitudinal axis 76 and the first light source 78 of the light-emitting head 26 are each parallel to the longitudinal axis 28 of housing 14 (FIG. 3). As such, the first light source 78 may emit light outward from the housing 14 and the light-emitting head 26. For example, the user may place the portable light 10 on a surface so the base 94 supports the portable light 10 and may turn on the first light source 78 using the user interface 30. This allows the user to illuminate an area surrounding the portable light 10 while having both hands free.

Now with reference to FIG. 7, when the light-emitting head 26 is in the open position (FIG. 7), the light-emitting head 26 is pivoted (e.g., about the pivot point 46) relative to the housing 14 so each light source 78, 82, 86 is visible. As such, the longitudinal axis 76 of the light-emitting head 26 is at an angle relative to the longitudinal axis 28 of the housing 14 of the portable light 10. In the illustrated embodiment, the light-emitting head 26 is able to pivot freely relative to the housing 14 so the angle between the longitudinal axis 76 of the light-emitting head 26 and the longitudinal axis 28 of the housing 14 is within a range of 0 degrees to 270 degrees. Additionally, the light-emitting head 26 may be rotated about the longitudinal axis 28 (e.g., clockwise or counterclockwise). FIG. 7 illustrates the longitudinal axis 76 of the light-emitting head 26 positioned at a 90-degree angle relative to the longitudinal axis 28 of the housing 14 of the portable light 10. As such, each light source 78, 82, 86 may emit light outward from each side of the light-emitting head 26 to illuminate the area surrounding the portable light 10. For example, when the light-emitting head 26 is in the open position, the user may grasp the grip portion 38 of the portable light 10 to position the portable light 10 in a desired position (e.g., through pivotable and rotational movement of the light-emitting head 26) and turn on one or more of the light sources 78, 82, 86 using the user interface 30.

Figure 8:
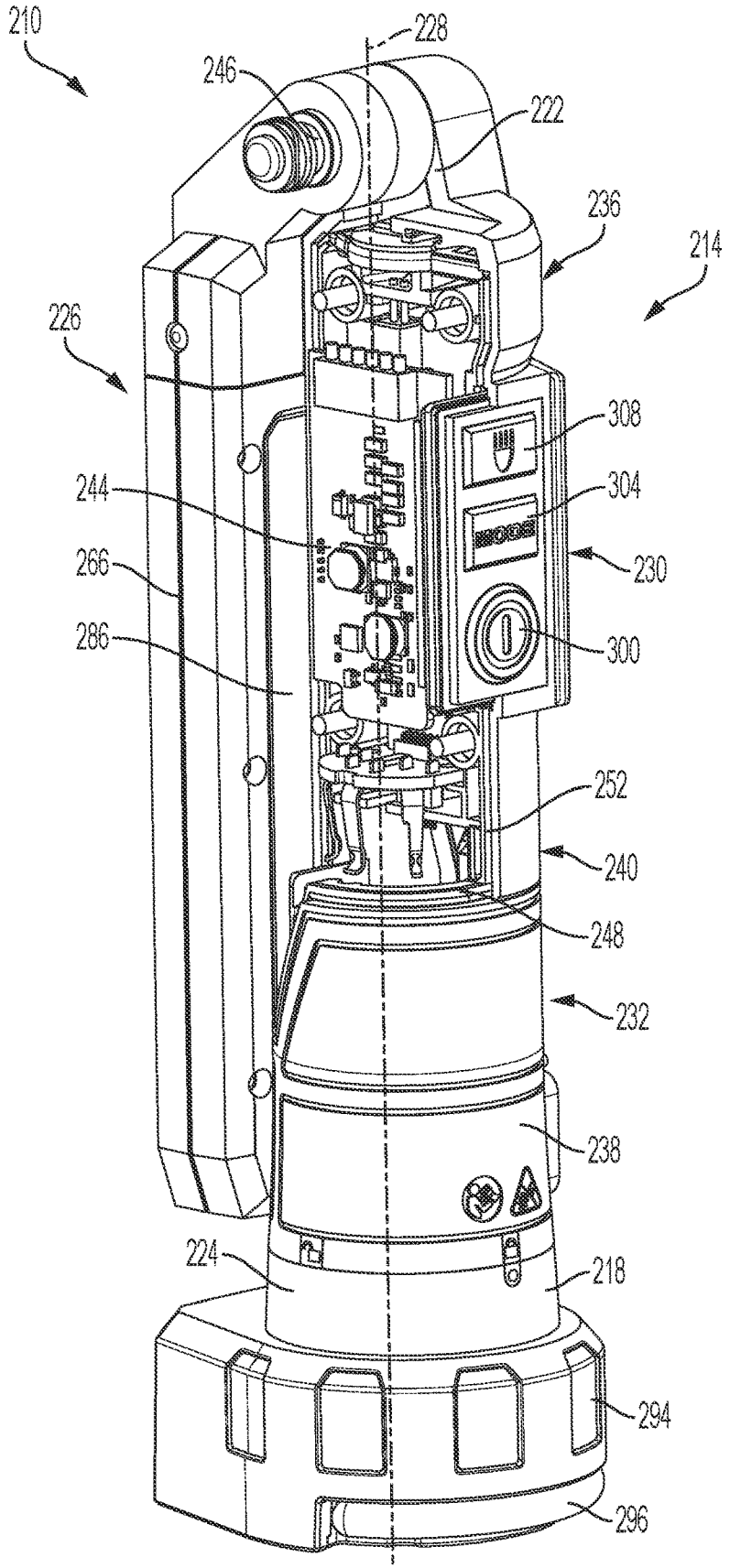
FIG. 8 is a perspective view of a portable light with a portion of a housing removed to illustrate a rotational feature of the portable light, according to some embodiments.

FIG. 8 illustrates a stick light 210 according to another embodiment. The stick light 210 is like the portable light 10 shown and described in FIGS. 1-7. Therefore, like structures will be referred to by like reference numerals plus "200" and only the differences between the two will be discussed herein. The stick light 210 includes an elongated housing 214 having a first end 218 and a second end 222 opposite the first end 218, a battery housing 224 coupled to the first end 218 of the housing 214 and sized to receive a battery cell (similar to battery cell 25, FIG. 5), and a light-emitting head 226 pivotably coupled to the second end 222 of the housing 214. The stick light 210 further includes light sources (e.g., three light sources similar to the light sources 78, 82, 86) that are coupled to the light-emitting head 226. A longitudinal axis 228 extends centrally through the first and second ends 218, 222 of housing 214. The stick light 210 further includes a user interface 230 formed on the housing 214 to selectively activate the light-emitting head 226.

The housing 214 includes a first (stationary) housing portion 232 that defines the grip portion 238 of the portable light 10 and a second housing portion 236 rotatably coupled to the first portion 216 via an interface 240. In the illustrated embodiment, the first housing portion 232 defines a battery receptacle which is formed as a recess in the first end 218 of the housing 214 to support the battery cell. The second housing portion 236 supports the user interface 230 and other electronic components 244 (e.g., control board, etc.) of the stick light 210. The interface 240 includes a rail 248 formed on the first housing portion 232 that engages with a protrusion 252 formed on the second housing portion 236 to allow the second housing portion 236 to rotate relative to the first housing portion 232. When the second housing portion 236 is rotated, the battery cell and the other electronic components 244 rotate with the second housing portion 236. In some embodiments, the battery housing 224 may rotate with the battery cell. As a result, a user can adjust the position of the light-emitting head 226 during use.

Figure 9:
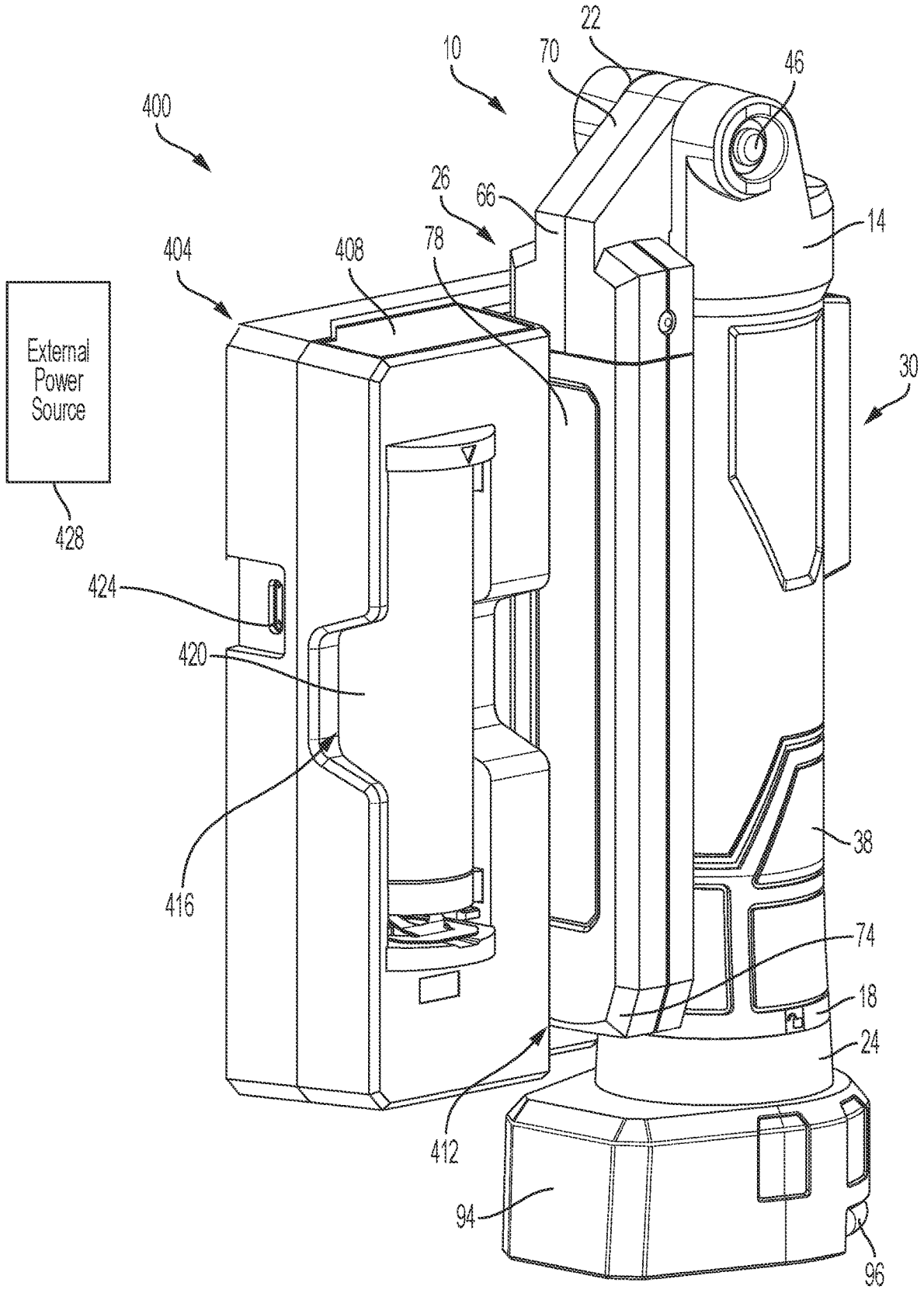
FIG. 9 is perspective view of a portable light assembly with the portable light of FIG. 1 coupled to a charger.
Figure 10:
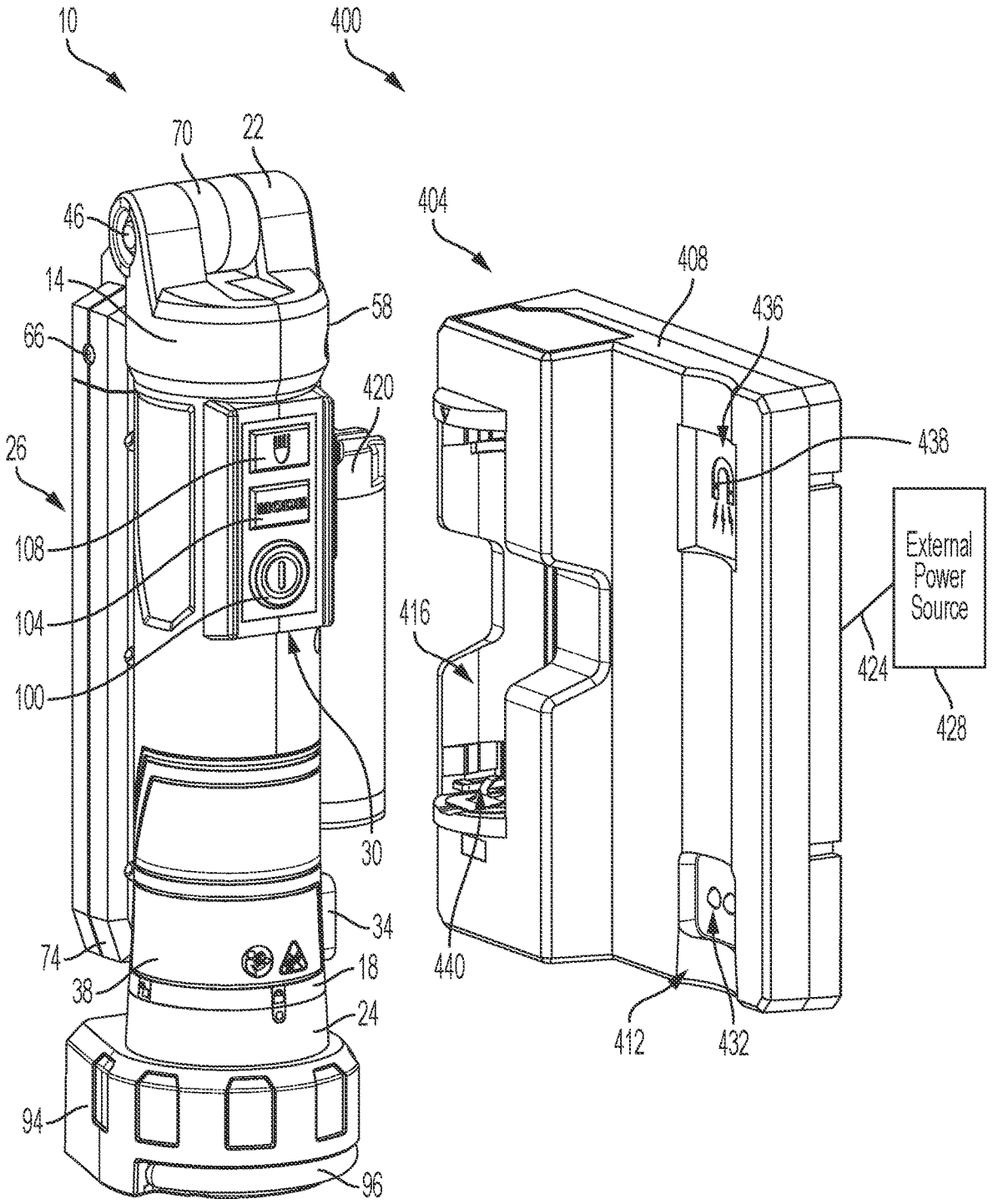
FIG. 10 is a perspective exploded view of the portable light assembly of FIG. 9.
Figure 11:
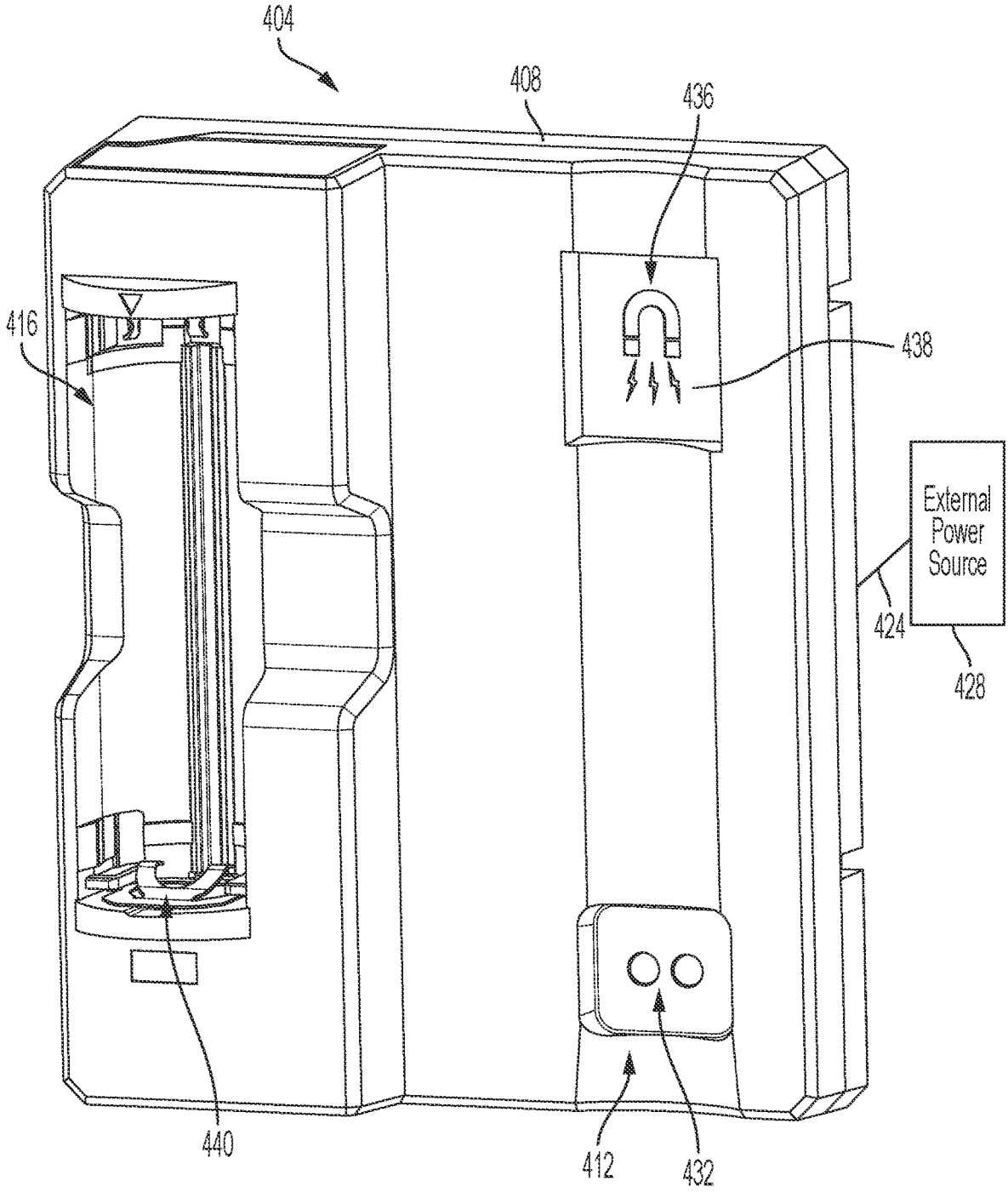
FIG. 11 is a perspective view of the charger of FIG. 9.

Now with reference to FIGS. 9-11, a portable light assembly 400 includes a charger 404 and the portable light 10 that can be coupled to the charger 404 to charge the battery cell 25 secured within the portable light 10. The charger 404 includes a housing 408 that defines a first cavity 412 sized to receive the portable light 10 and a second cavity 416 positioned adjacent the first cavity 412 and sized to receive a second battery cell 420. The second battery cell may be similar to the battery cell 25, described above (FIG. 5). The charger 404 further includes a plug 424 coupled to the housing 408, which couples the charger 404 to an external power supply 428. For example, the plug 424 may be integrally formed with the housing 408 and sized to engage with a standard 120 VAC outlet (e.g., a wall outlet). In other embodiments, the plug 424 may include a cord so the charger 404 can be spaced from the external power supply 428. In one embodiment, the plug 424 is a USB plug (e.g., USB 2.0, USB-C, etc.).

Now with reference to FIGS. 10 and 11, the first cavity 412 includes a first charging interface 432 that interacts with the charging interface 34 of the portable light 10 to charge the battery cell 25 within the portable light 10. In the illustrated embodiment, the first cavity 412 is sized to engage and receive the contour of the right side 58 of the portable light 10. For example, the first cavity 412 has a cylindrical shape, the charging interface 432 has a recess sized to receive the charging interface 34, and a recess 436 is sized to receive the USB port 42. Further, the recess 436 may include a magnet 438 that cooperates with the portable light 10 to secure the portable light within the first cavity 412. In the illustrated embodiment, the magnet 438 is positioned proximate a first, top end of the cavity 412 and the first charging interface 432 is positioned proximate a second, bottom end of the cavity 412. In other words, the first charging interface is vertically spaced from the magnet.

The second cavity 416 includes a second charging interface 440 that interacts with the second battery cell 420 to charge the second battery cell 420. In the illustrated embodiment, the second cavity 416 is cylindrical and is sized to receive the second battery cell 420. In other embodiments, an alternative battery pack, such as a M12 battery pack sold by Milwaukee Tool, may be used with the portable light 10. In such embodiments, the second cavity 416 may be differently sized to receive the battery cell or pack.

Further, the first cavity 412 and the second cavity 416 are parallel to each other such that the battery cell 25 of the portable light 10 and the second battery cell 420 are inserted within the cavities 412, 416 in the same orientation. In other words, the first battery cell 25 and the second battery cell 420 are respectively supported within the first and second cavity 412, 416 in the same orientation.

Figure 12:
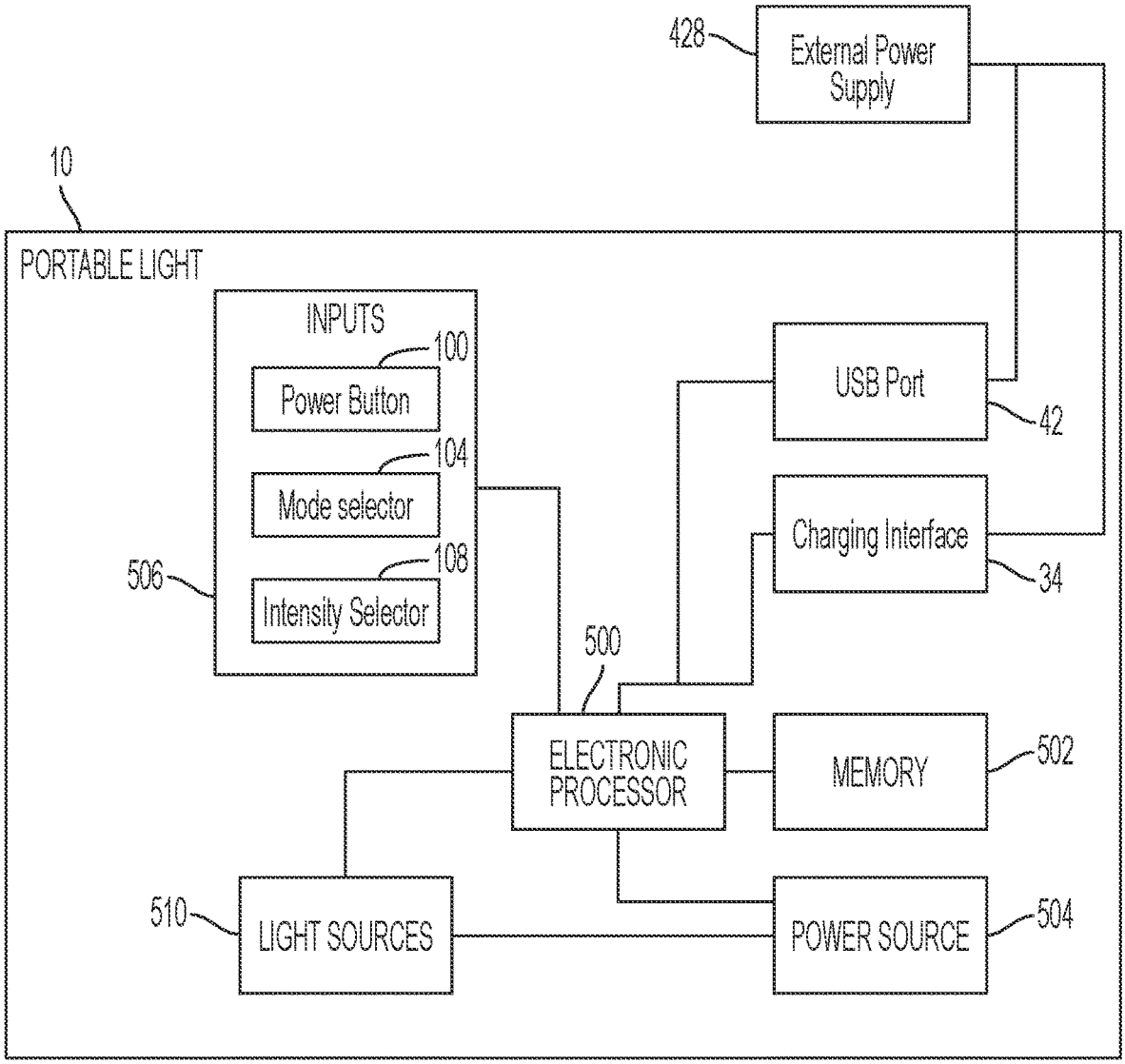
FIG. 12 is a block diagram illustrating the control circuitry of the portable light of FIG. 1, according to some embodiments.

Turning now to FIG. 12, a block diagram of the portable light 10 is shown, according to one embodiment. It should be appreciated that the block diagram applies equally to the portable light 210. As shown in FIG. 12, the portable light 10 includes an electronic processor 500, a memory 502, a power source 504 (e.g., the battery cell 25), one or more light sources 510 (e.g., light sources 78, 82, 86), one or more inputs 506, the USB port 42, and the charging interface 34. The electronic processor 500 is electrically coupled to a variety of components of the portable light 10 and includes electrical and electronic components that provide power, operational control, and protection to the components of the portable light 10. In some embodiments, the electronic processor 500 includes, among other things, a processing unit (e.g., a microprocessor, a microcontroller, or another suitable programmable device), a memory, input units, and output units. The processing unit of the electronic processor 500 may include, among other things, a control unit, an arithmetic logic unit ("ALU"), and registers. In some embodiments, the electronic processor 500 may be implemented as a programmable microprocessor, an application specific integrated circuit ("ASIC"), one or more field programmable gate arrays ("FPGA"), a group of processing components, or with other suitable electronic processing components.

In some embodiments, the electronic processor 500 may include a memory 502 (for example, a non-transitory, computer-readable medium) that includes one or more devices (for example, RAM, ROM, Flash memory, hard disk storage, etc.) for storing data and/or computer code for completing or facilitating the various processes, layers, and modules described herein. The memory 502 may include database components, object code components, script components, or other types of code and information for supporting the various activities and information structures described in the present application. The electronic processor 500 is configured to retrieve from the memory 502 and execute, among other things, instructions related to the control processes, algorithms, etc. The electronic processor 500 is also configured to store information on the memory 502.

In some embodiments, the power source 504 (e.g., the battery cell 25) is coupled to and transmits power to the electronic processor 500 and to one or more of the light sources 510. The power source 504 may include one or more batteries, as described above. The batteries may be removable and/or rechargeable. In some examples, the power source 504 includes other power storage devices, such as super-capacitors or ultra-capacitors. In some embodiments, the power source 504 includes combinations of active and passive components (e.g., voltage step-down controllers, voltage converters, rectifiers, filters, etc.) to regulate or control the power provided to the electronic processor 500 and/or the light sources 510. In some embodiments, the power source 504 is configured to provide a drive current to the light sources 510 based on control signals received from the electronic processor 500 to control an intensity of one or more of the light sources 510. In other words, an intensity of the light sources 510 is dependent on the drive current (i.e., power) received from the power source 504. In some embodiments, the electronic processor 500 is configured to control the drive current provided by the power source 504 to one or more of the light sources 510 by controlling a pulse width modulation ("PWM") duty cycle that controls when the power source 504 provides the drive current to the light sources 510.

In one example, the electronic processor 500 is configured to detect a user actuation of one or more of the inputs 506, such as the power button 100, the mode selector 104, and/or the intensity selector 108 of the user interface 30, by detecting a change in the state of the inputs 506. Based on the detected user actuation of the mode selector 104, the electronic processor 500 determines an operational mode for the light source 510 (for example, a high output operation mode, a low output operation mode, an off mode, single light mode, multiple light mode, or the like). Similarly, in response to detecting a user actuation of the intensity selector 108, the electronic processor 500 may vary the intensity of one of more of the light sources 510. In some embodiments, the portable light 10 may only have a power button 100. The power button 100 may be a temporary push button, a slider switch, a rotating knob, etc. Accordingly, in such embodiments, the power button 100 may provide both ON/OFF inputs, as well as allow a user to select a mode. For example, a user may actuate the power button 100 a certain number of times to switch the mode of the portable light 10. In one embodiment, the user may quickly actuate and release the power button 100 to change modes (e.g., HIGH mode, MED mode, LOW mode, single light mode, multiple light mode, etc.), and actuate and hold the power button 100 to power the portable light 10 ON or OFF. Similarly, where the portable light 10 includes the mode selector 104 and the intensity selector 108, actuations of the mode selector can indicate a desired mode and actuations of the intensity selector 108 can indicate a desired light intensity of the light source 510. For example, the user may actuate the mode selector 104, which cycles through the available modes of the portable light 10 (e.g., single light source one, two light sources on, three light sources on, etc.). The user may also actuate the intensity selector 108, which cycles through the available intensity modes of the portable light 10 (e.g., HIGH mode, MED mode, and LOW mode, etc.). Based on the selected mode, the electronic processor 500 then controls the power source 504 to provide a drive current to the one or more light sources 510 that corresponds to the selected operational mode. In some embodiments, the portable light 10 may include a separate actuator to select each mode.

The USB port 42 and the charging interface 34 are electronically connected to the power source 504 (e.g., the battery cell 25) via the electronic processor 500. The USB port 42 and/or the charging interface 34 may be electrically connected to an external power supply 428 to charge the power source 504 (e.g., the battery cell 25). In one embodiment, the external power source is a 5 VDC power supply, such as a USB connection. In other embodiments, the external power source may be a DC power source provided by a charger, such as charger 404 described above. In some instances, the external power supply may be an AC utility power supply that has been converted to DC for supply to the power source 504. In the illustrated embodiment, a USB cable may be used to electrically connect the USB port to the external power supply 428. Alternatively, the charging interface 34 mates with the charging interface 432 of the charger 404, which is coupled to the external power supply 428.

In some embodiments, one or more of the components shown in FIG. 12 may be located on a printed circuit board ("PCB"). In some embodiments, one or more of the components shown in FIG. 12 may be located elsewhere within or on the housing 14 of the portable light 10. In some embodiments, the portable light 10 includes additional, fewer, or different components than the components shown in FIG. 12. For example, the portable light 10 may additionally include a display to indicate an operational mode of the portable light 10. As another example, the portable light 10 may include current and/or voltage sensors that measure the current being drawn by the light source 510 (i.e., drive current) and/or the voltage of the power source 504.

Although the various embodiments have been described in detail with reference to certain preferred embodiments, variations and modifications exist within the scope and spirit of one or more independent aspects as described. Various features and advantages are set forth in the following claims.

What is claimed:

1. A portable light comprising:

an elongated housing having a first end and a second end opposite the first end, wherein the elongated housing further includes a first housing portion rotatably coupled to a second housing portion;

a light-emitting head pivotably coupled to the second end of the elongated housing, the light-emitting head having a housing portion defining a first end and a second end opposite the first end;

a first light source coupled to a first side of the light-emitting head and positioned between the first end and the second end of the housing portion;

a second light source coupled to the second end of the housing portion; and a battery cell removably coupled to the elongated housing to power the first and second light sources, wherein the battery cell is configured to rotate relative to the first housing portion with the second housing portion;

wherein the light-emitting head is pivotably coupled at the first end to the elongated housing at a pivot point.

2. The portable light of claim 1, further comprising a third light source coupled to a second side of the light-emitting head, opposite the first side, and positioned between the first end and the second end of the housing portion.

3. The portable light of claim 2, wherein one or more of the first, second, or third light sources are LED light sources.

4. The portable light of claim 2, further comprising a user interface electrically coupled to the battery cell and the first, second, and third light sources through a controller within the elongated housing to control operation of the portable light.

5. The portable light of claim 4, wherein the user interface includes a power button configured to turn on or off the first, second, and third light sources, and a mode selector configured to adjust whether one or more of the first light source, the second light source, and the third light source are powered on.

6. The portable light of claim 1, wherein the battery cell is coupled to the first end of the elongated housing, and the light-emitting head is movable between a collapsed position and an open position.

7. The portable light of claim 1, wherein the light-emitting head is rotatably coupled to the second end of the elongated housing such that the light-emitting head can rotate about a longitudinal axis of the portable light.

8. A portable light comprising:

an elongated housing having a first housing portion defining a grip portion and a second housing portion coupled to the first housing portion;

an interface that rotatably couples the first housing portion to the second housing portion;

a light source coupled to the second housing portion of the elongated housing; and a battery cell supported within the first housing portion and configured to power the light source, wherein the battery cell is configured to rotate relative to the first housing portion with the second housing portion.

9. The portable light of claim 8, further comprising a light-emitting head pivotably coupled to the second housing portion, and wherein the light source is coupled to the light-emitting head.

10. The portable light of claim 8, wherein the first housing portion defines a battery receptacle which is formed as a recess in an end of the first housing portion to support the battery cell.

11. The portable light of claim 8, wherein the second housing portion supports a user interface and electronic components of the portable light.

12. The portable light of claim 11, wherein the user interface and the electronic components co-rotate with the second housing portion.

13. The portable light of claim 11, wherein the user interface is electrically coupled to the battery cell and the light source through a controller within the elongated housing to control operation of the portable light.

14. The portable light of claim 13, wherein the user interface includes a power button and an intensity selector.

15. The portable light of claim 8, wherein the interface includes a rail formed on the first housing portion that engages with a protrusion formed on the second housing portion to allow the second housing portion to rotate relative to the first housing portion.

16. A portable light assembly comprising:

a portable light including:

an elongated housing having a first housing portion at a first end and a second housing portion at a second end opposite the first end, a light-emitting head pivotably coupled to the second end of the elongated housing;

a first battery cell supported within the elongated housing and configured to power the light-emitting head, wherein the battery cell is configured to rotate relative to the first housing portion with the second housing portion, and a portable light charging interface positioned on a side of the elongated housing between the first end and the second end; and a charger including:

a housing defining a first cavity sized to receive at least a portion of the portable light and a second cavity spaced apart from the first cavity and sized to receive at least a portion of a second battery cell, a first charging interface positioned within the first cavity, the first charging interface configured to interact with the portable charging interface when the portable light is received in the first cavity to charge the first battery cell, and a second charging interface positioned within the second cavity, the second charging interface configured to interact with a second battery cell when the second battery cell is received in the second cavity to charge the second battery cell.

17. The portable light assembly of claim 16, wherein the first cavity includes a magnet that cooperates with the portable light to secure the portable light within the first cavity.

18. The portable light assembly of claim 17, wherein the magnet is offset from the first charging interface.

19. The portable light assembly of claim 16, wherein the charger further includes a plug coupled to the housing and configured to be attached to an external power supply.

20. The portable light assembly of claim 16, wherein the light-emitting head is pivotably coupled to the housing at a pivot point and is movable between a collapsed position and an open position, and wherein the first cavity is sized to receive the portable light when the light-emitting head is in the collapsed position.

* * * * *